US005755361A

United States Patent [19]

Restive et al.

[11] Patent Number: 5,755,361

[45] Date of Patent: May 26, 1998

[54] PUMP SPRAYER

[75] Inventors: Mario J. Restive, Frankfort; Alexander C. Samacki, Utica, both of N.Y.

[73] Assignee: The Fountainhead Group, Inc., New York Mills, N.Y.

[21] Appl. No.: 584,184

[22] Filed: Jan. 11, 1996

[51] Int. Cl.[6] ..... B05B 11/02

[52] U.S. Cl. ..... 222/209; 222/383.1; 239/333

[58] Field of Search ..... 239/328, 327, 239/333, 8, 373, 92–96; 222/207–209, 386.5, 401, 383

[56] References Cited

U.S. PATENT DOCUMENTS

| | | | |
|---|---|---|---|
| 1,297,865 | 3/1919 | Kirkwood . | |
| 1,520,502 | 12/1924 | Lundblad . | |
| 2,162,057 | 6/1939 | Brandt et al. . | |
| 2,543,319 | 3/1951 | Sundholm . | |
| 2,653,848 | 9/1953 | Lee . | |
| 3,123,254 | 3/1964 | Rabby et al. . | |
| 3,235,135 | 2/1966 | Robert et al. | 239/329 X |
| 3,452,905 | 7/1969 | Micallef . | |
| 3,519,167 | 7/1970 | Rast . | |
| 3,746,261 | 7/1973 | Nozawa et al. . | |
| 3,767,078 | 10/1973 | Gortz et al. . | |
| 3,995,774 | 12/1976 | Cooprider et al. . | |
| 4,102,476 | 7/1978 | Loeffler | 239/329 X |
| 4,142,653 | 3/1979 | Mascia et al. . | |
| 4,167,941 | 9/1979 | Capra et al. . | |
| 4,222,500 | 9/1980 | Capra et al. . | |
| 4,241,853 | 12/1980 | Pauls et al. . | |
| 4,324,350 | 4/1982 | Thompson . | |
| 4,423,829 | 1/1984 | Katz . | |
| 4,735,239 | 4/1988 | Salmon et al. . | |
| 4,787,560 | 11/1988 | DeYoreo . | |
| 4,867,208 | 9/1989 | Fitzgeraki et al. . | |
| 4,869,402 | 9/1989 | Ash et al. | 222/209 |
| 4,875,508 | 10/1989 | Burke, II et al. . | |
| 4,953,753 | 9/1990 | Gortz . | |
| 4,955,512 | 9/1990 | Sharples . | |
| 5,080,652 | 1/1992 | Sancoff et al. . | |
| 5,111,971 | 5/1992 | Winer . | |
| 5,137,175 | 8/1992 | Kowalski et al. . | |
| 5,183,185 | 2/1993 | Hutcheson et al. . | |
| 5,187,498 | 2/1993 | Burger . | |
| 5,240,151 | 8/1993 | Worm . | |
| 5,303,853 | 4/1994 | Nye . | |
| 5,335,853 | 8/1994 | Wirz . | |

FOREIGN PATENT DOCUMENTS

| | | | |
|---|---|---|---|
| 181214 | 2/1907 | Germany | 222/386.5 |
| 31279 | 2/1992 | Japan | 222/386.5 |
| 1072 | 2/1991 | WIPO | 222/386.5 |

*Primary Examiner*—Kevin Weldon

*Attorney, Agent, or Firm*—Bond, Schoeneck & King, LLP

[57] ABSTRACT

A pump sprayer is disclosed for dispensing fluids such as insecticides and herbicides. The sprayer comprises a supply container which holds the fluid to be dispensed, a manually-operated piston pump, a pressure vessel or accumulator, and a manual control valve for controlling fluid dispensed through a spray wand. The accumulator includes an elastomeric bladder which is adapted to accumulate fluid from the pump and to deliver the fluid to the spray wand at a desired pressure. In order to provide a pump sprayer which can deliver fluid at a substantially constant pressure from a fluid supply contained in conventional containers, the pump and elastomeric bladder are configured to pass through the fill openings of the containers and to be secured therein during operation of the sprayer.

3 Claims, 9 Drawing Sheets

FIG. 5
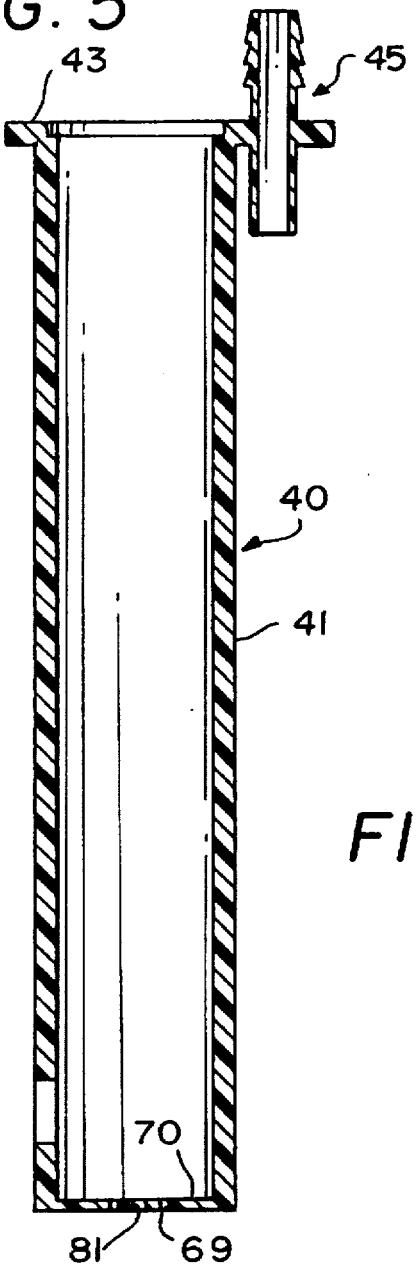
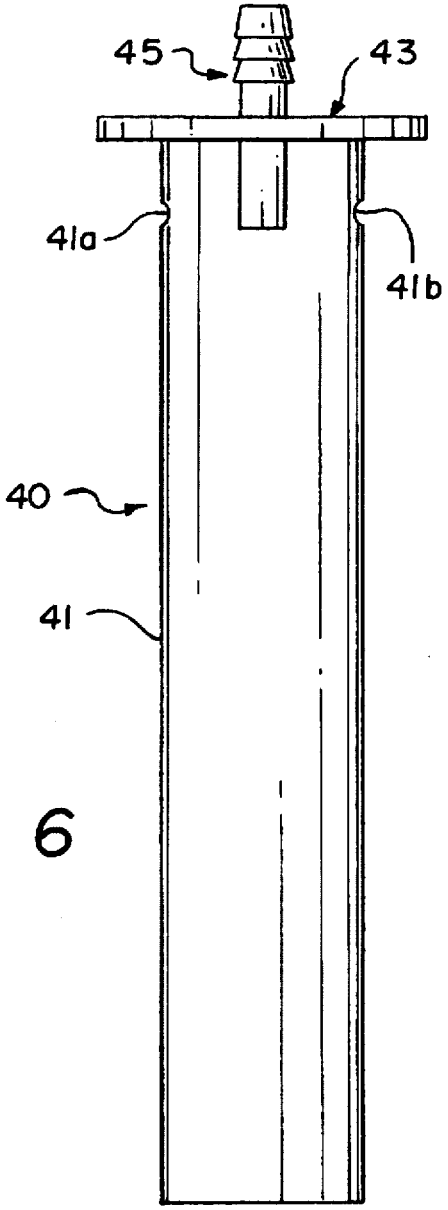
FIG. 6
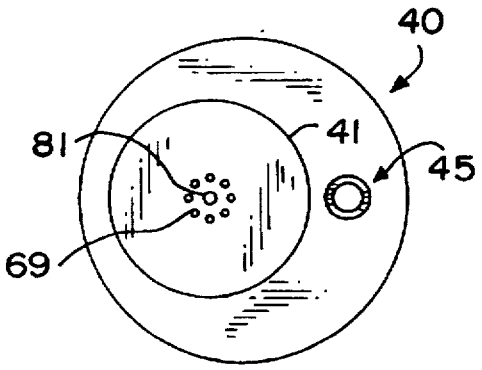
FIG. 7
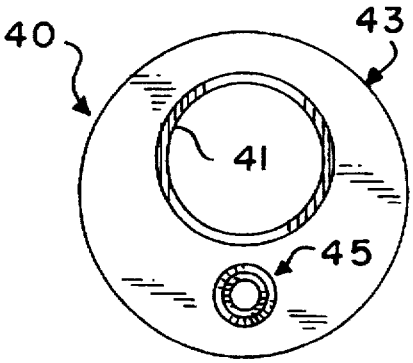
FIG. 8

PUMP SPRAYER

CROSS REFERENCE TO RELATED APPLICATION

Reference is made to U.S. patent application No. 08/509,149, entitled Improved Sprayer Apparatus, filed in the name of Mario J. Restive, on Jul. 31, 1995; which application is assigned to assignee of the present invention.

BACKGROUND OF THE INVENTION

1. Technical Field

The present invention relates to pump sprayers, and more particularly, to sprayers of the type which employ an expandable accumulator as a pressure source for discharging fluid from a spray nozzle.

2. Background Art

Compressed air sprayers which employ a manually operated piston air pump are commonly used for dispensing fluids such as insecticides, herbicides, sealants, cleaning fluids and other liquids. Such sprayers normally include a specially designed container, tank or bottle which serves both to hold the fluid to be dispensed and to act as a pressure vessel (i.e., the pressure source for the liquid). Such conventional containers, of course, have a fixed volume.

In operation of a compressed air sprayer, the air pump pumps air from outside the container to inside the container. Initially, the fluid and air in the container is at ambient pressure. As air is pumped into the container, the air in the container is compressed. The compressed air acts as a spring on the fluid and provides a pressure source for discharging fluid from the container.

One problem in pump sprayers having conventional compressed air containers is that the pressure exerted on the fluid in the container does not remain constant as the fluid is dispensed and the volume of fluid in the container changes. There is a continuously decreasing discharge pressure as fluid in the container is discharged, and this characteristic results in the requirement for a relatively high container pressure to achieve an extended spray duration. Further, if a constant spray rate is required, a pressure regulator must be used with the sprayer, and the addition of a pressure regulator adds to the expense of the sprayer. Also, compressing air is an inefficient way of storing energy to provide the motive force for the sprayer.

Another problem in known compressed air sprayers is that the supply container must be thoroughly cleaned after it is used with one chemical before a different chemical can be dispensed. In some cases, an unused chemical must be removed from the supply container and stored for future applications. Such cleaning and storage of chemicals is messy, time consuming and costly. A sprayer apparatus has been designed to operate with standard containers which can be used once and discarded after a particular application. These standard refill containers are normally of relatively light construction, and thus are only suitable for low pressure applications, such as trigger sprayer applications. However unlike trigger sprayers, compressed air sprayers operate under significantly greater pressures which requires heavy gauge, reinforced steel or plastic containers. Thus, standard, lightweight, refill containers have not been proposed or even suggested for compressed air sprayer applications.

A trigger sprayer, employing standard refill containers is shown in the patent to Pauls et al., U.S. Pat. No. 4,241,853. The trigger pump mechanism is attached to the top of the standard container. The pump mechanism includes a resilient bladder which is charged with fluid drawn from the container by means of a piston pump. Fluid can be dispensed from the bladder in a continuous stream or in an intermittent discharge. A disadvantage of the Pauls et al. device is that all of the pump structure is located outside the container, with the exception of a dip tube which extends into the liquid. As a result of such construction, the volume of the liquid dispensed is limited by the relatively small pump and bladder. In addition, the palm/finger actuation of the trigger mechanism to charge the Pauls device is fatiguing and may, with repetitive use, contribute to medical problems such as carpal tunnel syndrome. Further, the grouping of all of the working components above and outside the container substantially increases the complexity of the dispenser.

SUMMARY OF THE INVENTION

One object of the present invention is to overcome the problems in the prior art discussed above and to provide an improved pump sprayer apparatus.

It is another object of the present invention to provide a pump sprayer apparatus that delivers fluid at a substantially constant pressure and relatively long operating pressure duration without an external pressure regulator device.

A further object of the present invention is to provide a pump sprayer apparatus which is particularly suitable for use with containers of relatively light construction.

It is another object of the present invention to provide a relatively low cost and efficient device for spraying a liquid.

Another object is to provide a pressurizing mechanism that does not require repetitive finger movement, and is therefore non-fatiguing.

A further object of the present invention is the creation of an operating pressure upon the first pump stroke, independent of the volume of air in the container.

It is yet another object of the present invention to provide a pump sprayer apparatus which is particularly suitable for use with standard refill containers.

It is yet a further object of the present invention to provide a pump sprayer apparatus which is mountable on and operable through the fill openings of standard supply containers.

It is still another object of the present invention to provide a pump sprayer apparatus which is adaptable to deliver a substantially constant fluid pressure to different types of dispensers.

It is still a further object of the present invention to provide an expandable accumulator for a pump sprayer apparatus which automatically regulates the pressure therein to a predetermined level.

It is still another object of the present invention to provide an expandable accumulator for a pump sprayer apparatus which includes blowout protection, as well as an automatic deflating mechanism.

These and other objects are obtained in accordance with the present invention wherein there is provided a pump sprayer comprising a supply container, which can be a standard refill container, and a pump sprayer apparatus for use with the supply container. The pump sprayer apparatus includes a pump assembly, an expandable accumulator, and a dispensing or discharge assembly. The supply container is designed to hold a specific quantity of a fluid to be dispensed, such as water, water sealant, or an insecticide, herbicide, or fungicide. It is understood the present invention is not limited to these types of liquids, but may employ any sprayable liquid.

The pump assembly includes an elongated casing and a piston mounted for reciprocating movement in the casing. The piston includes a handle which is accessible to an operator. A manifold is fixed to one end of the pump casing, and an expandable accumulator is connected to and in fluid connection with the manifold. The expandable accumulator is an elastomeric bladder which functions to accumulate fluid under pressure as the bladder expands from an initial volume condition to an expanded volume condition. When the operator moves the pump piston in one direction, fluid from the supply container is drawn into the pump casing through an intake valve in the casing. When the piston is moved in an opposite direction, fluid is forced into the manifold and bladder through a unidirectional valve. Although not required in order to create an operating pressure, the pump may be operated through several cycles, until the bladder expands and reaches its expanded volume condition. Fluid from the bladder is delivered to the dispensing assembly through a supply tube, and a control valve in the dispensing assembly controls the discharge of fluid through a nozzle.

In order to provide a spray apparatus which can be used with standard containers having relatively narrow fill openings, the pump assembly and the expandable accumulator are configured and dimensioned to pass through the fill opening of the container, and to be secured therein by a threaded connector which mates with threads on the neck of the fill opening.

A particular advantage of the present invention is that the pump sprayer is adapted to produce a substantially constant pressure stream of fluid from a conventional container of light construction. Fluid is delivered at a substantially constant pressure by the use of an elastomeric bladder. The necessary operating pressure can be readily generated in the pump sprayer as a result of locating the piston pump in the container such that the pump can have a relatively long stroke and the operator can exert considerable force on the pump piston. A conventional container of light construction can be used, since the pressure generated by the pump is contained in the elastomeric bladder, and thus, the walls of the container do not have to withstand the pressure.

A further advantage of locating the pump mechanism, valving and accumulator within the container is that any leakage will not expose the operator to the liquids. Also, such containment provides a measure of redundancy; in that the expandable accumulate is housed within the container itself.

Further, the present invention allows the hand operated trigger to function only as an on/off mechanism, thereby reducing complexity and operator effort.

BRIEF DESCRIPTION OF THE DRAWING

Further objects of the present invention will become apparent from the following description of the preferred embodiments with reference to the accompanying drawings in which:

FIG. 5 is a sectional view of the pump casing;

FIG. 6 is a side elevational view of the pump casing;

FIG. 7 is a bottom plan view of the pump casing as shown in FIG. 6;

FIG. 8 is a top plan view of the pump casing as shown in FIG. 6;

DESCRIPTION OF THE PREFERRED EMBODIMENTS

Figure 1:
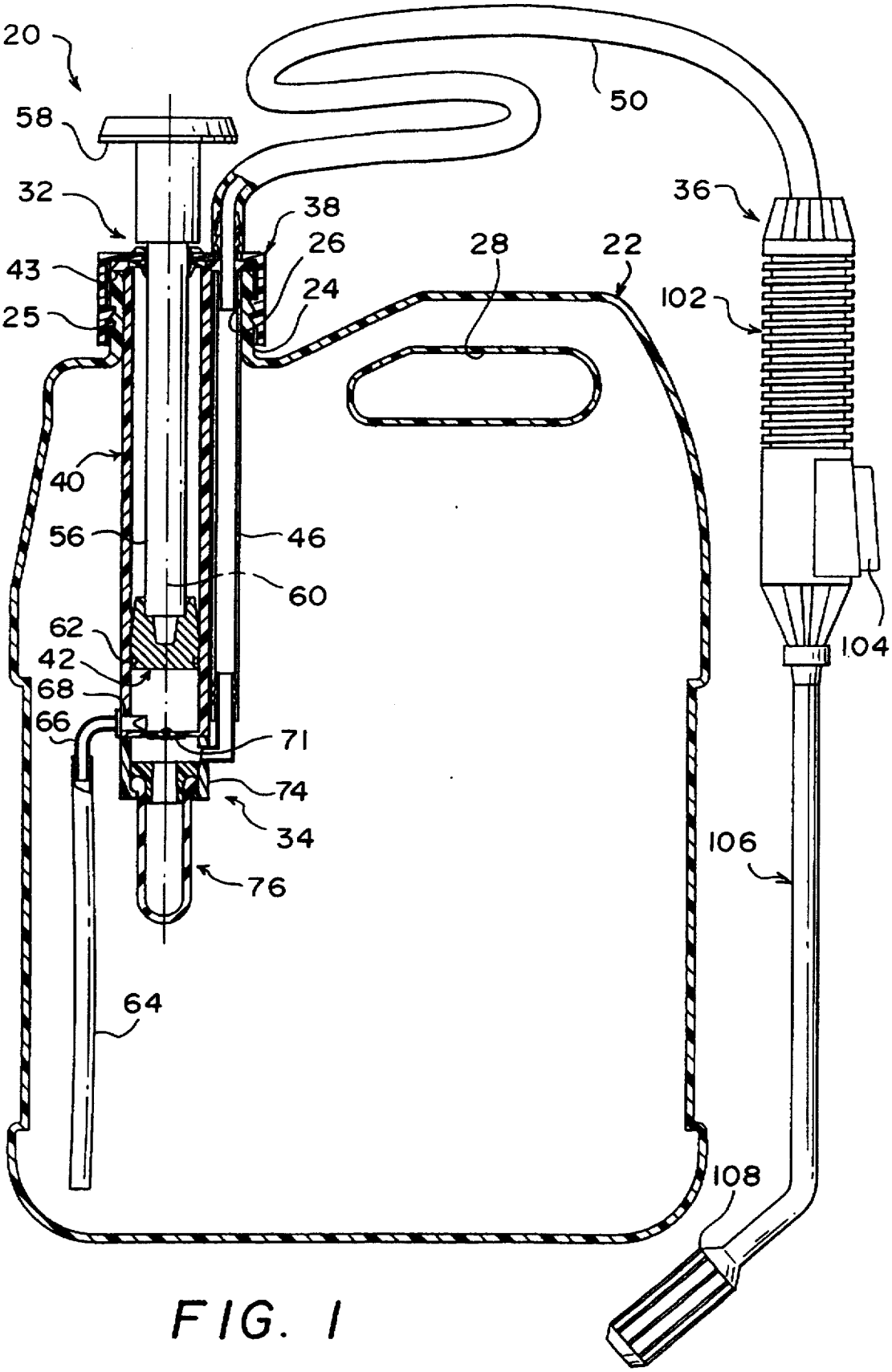
FIG. 1 is a front elevational view of the pump sprayer of the present invention, with certain parts shown in section.

With reference to FIG. 1, there is shown a pump sprayer apparatus 20 constructed in accordance with the present invention. Sprayer apparatus 20 is configured to be mounted on a supply tank or container 22. Sprayer apparatus 20 is suitable for applying insecticides, herbicides, fungicides, pesticides, water sealants, detergents and other chemical compositions. However, any other sprayable liquids may be applied with the present apparatus. Thus, supply container 22 must be inert to such compositions. As shown in FIG. 1, container 22 includes a neck 24 on a top side thereof. Neck 24 has threads 25 formed around its outer periphery and a fill opening 26 in the interior thereof. A container handle 28 is formed in a top portion of container 22. As will be apparent hereinafter, sprayer apparatus 20 is intended to function with different types of containers to hold the fluid supply, including conventional or standard containers. It is contemplated that a container, such as container 22, could be used, for example, to contain premixed chemicals which could be sold in the container. To use such a container as a supply container 22 for sprayer apparatus 20, the customer would simply remove a cap (not shown) screwed on neck 24 and install sprayer apparatus 20 of the present invention.

Figure 2:
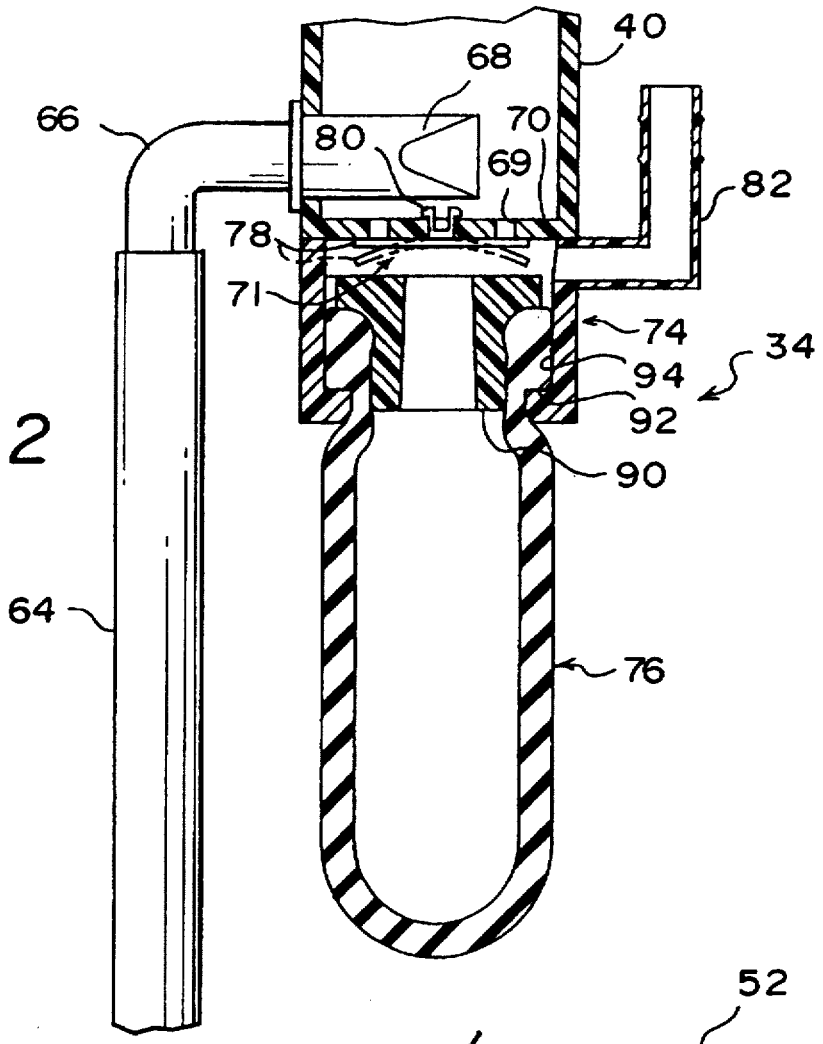
FIG. 2 is a sectional view of the expandable accumulator means and a bottom portion of the pump casing.
Figure 3:
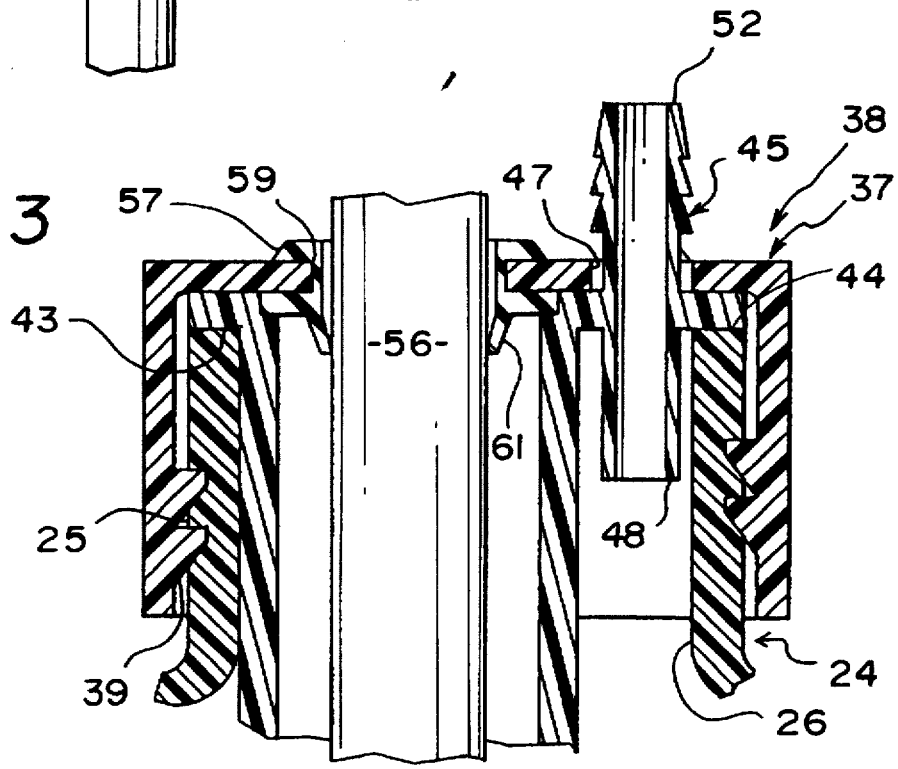
FIG. 3 is a sectional view of the attachment means of the pump sprayer, and portions of the pump casing and supply tank.

As shown in FIG. 1, sprayer apparatus 20 includes a pump assembly 32 (See also FIGS. 5–8), an accumulator assembly 34 (See also FIGS. 2 and 4), a dispensing assembly 36, and an attachment assembly 38 (See also FIG. 3).

Attachment assembly 38 is adapted to detachably secure the sprayer apparatus 20 on container 22. As shown in FIG. 3, the attachment assembly 38 includes a generally cylindrical closure member 37 which contains internal threads 39. Threads 39 are adapted to mate with threads 25 on container 22.

As shown in FIG. 1, the pump assembly may be a positive displacement pump and 32 comprises a pump casing 40 and a piston 42 mounted for reciprocating movement in casing 40. As shown in FIGS. 5–8, the casing 40 includes a cylinder 41 and an annular flange 43 formed on an upper end of cylinder 41. As shown in FIG. 3, the flange 43 is adapted to seat on an edge 44 of the container neck 24, and includes a tubular fitting 45 formed integrally therewith. The fitting 45 extends through an opening 47 in the closure 37, and is adapted to receive a fluid supply tube 46 (See FIG. 1) on an end 48 and a fluid discharge tube 50 on an opposite end 52. Alternative attachment configurations may be employed, such as friction, snap or twist fits, wherein the attachment may be releasable or fixed.

A piston rod 56 is connected at one end to a piston 42 and at an opposite end to a handle 58. Piston 42 contains an O-ring 62 mounted thereon to maintain a seal between piston 42 and an interior wall of cylinder 41. Piston 42 can be made, for example, from polyethylene or from stainless steel. As best shown in FIG. 3, piston rod 56 is held in position as it moves by an annular sealing element or wiper 57 which is fitted in an opening 59 of the closure member 37. Wiper 57 maintains a fluid seal at the upper end of the cylinder 41 by means of a flexible lip 61 which rides on piston rod 56. The wiper element 57 can be made from a synthetic rubber, sold under the trademark BUNA-N 70.

The piston 42 is movable in the cylinder 41 along an axis 60 (FIG. 1) by means of handle 58. When piston 42 is raised, as viewed in FIG. 1, fluid in container 22 is drawn into cylinder 41 through an inlet or dip tube 64, an L-bend fitting 66, and an intake valve 68 which can be, for example, an inexpensive duckbill valve. The valve 68 prevents fluid from flowing back into the supply container 22. When the direction of the piston 42 is reversed (moved downward, as viewed in FIG. 1), fluid in the cylinder 41 is forced through a plurality of ports 69 (See FIGS. 2, 4–5 and 7) in a bottom wall 70 of cylinder 41, through a unidirectional valve 71 (See FIG. 2), and into the accumulator assembly 34.

As best shown in FIG. 2, the valve 71 may be an umbrella valve which includes a flexible disc 78. The flexible disc 78 is fixed to the bottom wall 70 by means of a spring clip 80. Spring clip 80 is adapted to be pressed into a hole 81 in the bottom wall 70, and is retained therein by a flange 83 (See FIG. 4). When fluid is forced through the ports 69, disc 78 flexes (to the position shown in phantom lines in FIG. 2) to permit fluid to pass into accumulator assembly 34. When the piston 42 is again moved upward to draw in a new charge of fluid, the valve 71 will close as a result of energy stored in the flexed disc 78 and fluid pressure in the accumulator assembly 34.

As shown in FIG. 1, the cylinder 41 extends vertically a substantial distance into container 22. This arrangement makes it possible for the piston 42 to have a relatively long stroke which facilitates the filling of accumulator assembly 34. The vertical orientation of the cylinder 41 makes it possible for the operator to exert a considerable downward force on piston 42 and thereby generate a pressure in accumulator assembly 34.

Figure 4:
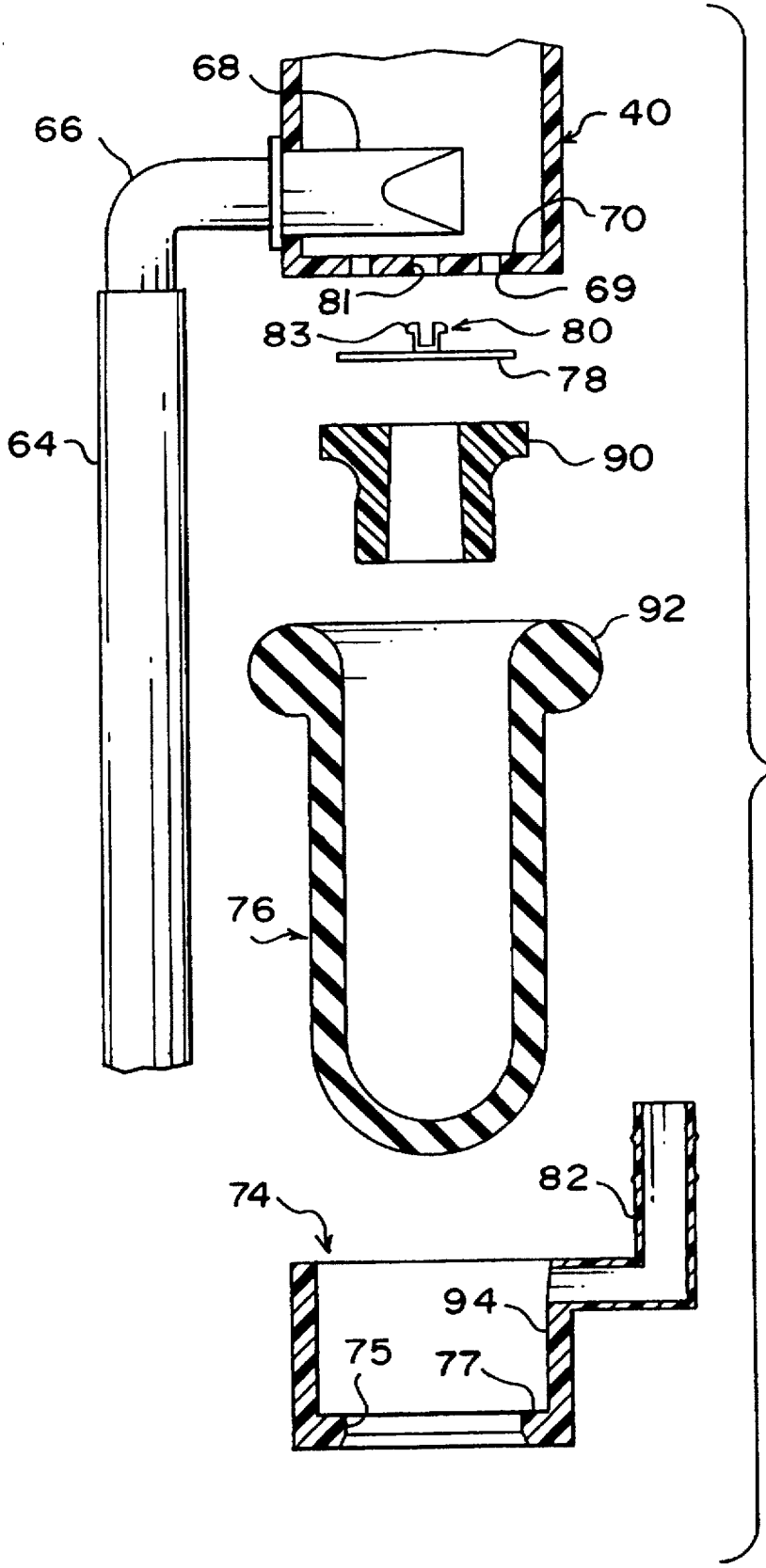
FIG. 4 is an exploded sectional view of the elements shown in FIG. 2.

As shown in FIG. 2, the accumulator assembly 34 comprises a manifold 74, an expandable accumulator 76, a supply tube 46 for delivering fluid to dispensing assembly 36. As best shown in FIG. 4, a manifold 74 is a generally cup-shaped element which has an opening 75 in a bottom portion 77 and an L-shaped fitting 82 adapted to receive one end of supply tube 46. The manifold 74 is fixed to the bottom wall 70 by any well-known means, including an adhesive or sonic welding, to form a fluid tight seal with bottom wall 70. As shown in FIGS. 2 and 4, the accumulator 76 is secured to manifold 74 by a resilient retainer ring 90. Ring 90 wedges an annular flange 92 of the accumulator 76 against an interior wall 94 of the manifold 74.

As shown in FIG. 1, the accumulator 76, the manifold 74, and the pump casing 40 are coaxial, and all of the elements of the sprayer apparatus 20 which are received in the container 22 are arranged along axis 60. This is the preferred embodiment, since it greatly facilitates the insertion of the sprayer apparatus 20 in the fill opening of a standard container. However, in some applications, for example, for relatively short containers, it may be desirable to mount the expandable accumulator at an angle to axis 60, in order to decrease the overall length of the apparatus 20 in the container 22. Since the accumulator 76 is quite flexible, it would be possible to mount the accumulator at an angle to axis 60 without requiring an increase in size of the container fill opening, to accommodate the sprayer apparatus 20.

The expandable accumulator 76 can be constructed as described in the aforementioned U.S. patent application, Ser. No. 08/509,149, entitled Improved Sprayer Apparatus, filed on Jul. 31, 1995, assigned to the same assignee as the present invention, and the disclosure of which is expressly incorporated herein by reference. As disclosed therein, the expandable accumulator 76 is preferably an elastomeric bladder and can be made from a synthetic rubber, sold under the trademark BUNA-N or any other suitable thermal plastic elastomers. The function of the elastomeric bladder is to accumulate the fluid under pressure as its volume expands from an initial volume to an expanded volume. As the elastomeric bladder expands from an initial volume condition to an expanded volume condition (when pressurized fluid is pumped into the bladder), energy is being stored in the elastic material of the bladder. The energy is transferred to the fluid when the fluid is discharged from the bladder. As the liquid is discharged, the volume of the bladder contracts from the expanded volume to its initial volume to provide the operating pressure.

An elastomeric bladder stores and transfers energy very efficiently because of the elastic properties of the bladder. Another important property of the bladder is that it will hold a constant operating pressure as its volume expands and contracts. This property provides the sprayer of the present invention with a substantially constant pressure source, and eliminates the need for a pressure regulator for constant pressure applications.

Fluid is discharged from sprayer apparatus 20 through dispensing assembly 36. As shown in FIG. 1, dispensing assembly 36 comprises discharge tube 50 which provides a fluid connection between attachment means 38 and a discharge valve (not shown) included in a handle 102. The assembly 36 also includes a spray wand 106 and a nozzle 108 at the end of the wand 106. The discharge valve in the handle 102 is constructed and functions generally in the same manner as the discharge valve 140 shown in FIG. 9. The discharge valve is actuated by a spring-loaded button 104.

As fluid is discharged from the container 22, there is a need to equalize the pressure between the inside and outside of the container 22. This is accomplished by operation of the wiper 57 and the fluid equalization holes **41*a* and 41*b* (See FIG. 6) contained in the cylinder 41. As shown in FIG. 3, the flexible lip 61 of the wiper 57 operates as a burping valve which opens upon the development of a negative pressure differential in the container 22. Pressure equalization is then achieved through the holes 41*a* and 41*b* which provide fluid communication between the interior of the cylinder 41 and the inside of the container 22. The holes 41*a* and 41*b* also function to drain off any fluid that finds its way into the cylinder 41, above the piston 42 (as a result of "blow-by" past piston 41**).

Figure 9:
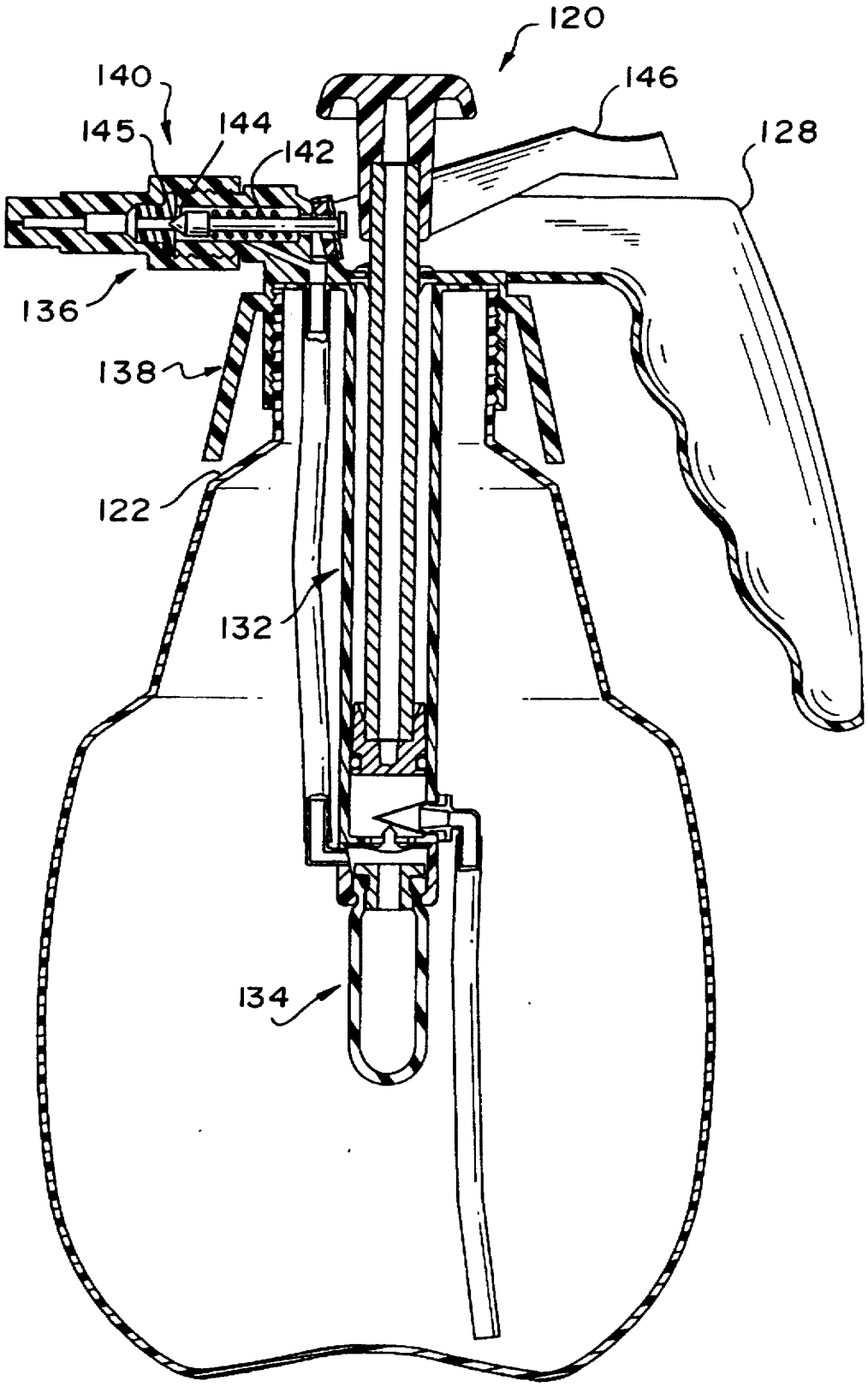
FIG. 9 is a sectional view of another embodiment of the pump sprayer of the present invention.

With reference to FIG. 9, there is shown another embodiment of the present invention. As shown therein, the sprayer apparatus 120 is configured to be detachably mounted to a supply container 122. The sprayer apparatus 120 is configured to resemble a compressed air bottle sprayer. The sprayer apparatus 120 includes a pump assembly 132, an accumulator assembly 134, a dispensing or discharging assembly 136, and an attachment assembly 138. The pump assembly 132 and the accumulator assembly 134 are generally similar to the pump assembly 32 and the accumulator assembly 34, respectively, of the first embodiment shown in FIG. 1, thus, a detailed explanation will not be given for these elements. The sprayer apparatus 120 differs from the sprayer apparatus 20 in that a handle 128 and a discharge valve 140 are integrally formed with attachment assembly 138. The valve 140 is designed to be normally in a closed position and is held therein by a compression spring 142 which urges a head 144 against a valve stop 145. A discharge lever 146 is operable to the pull head 144 back against the spring 142 to the open valve 140.

Figure 10:
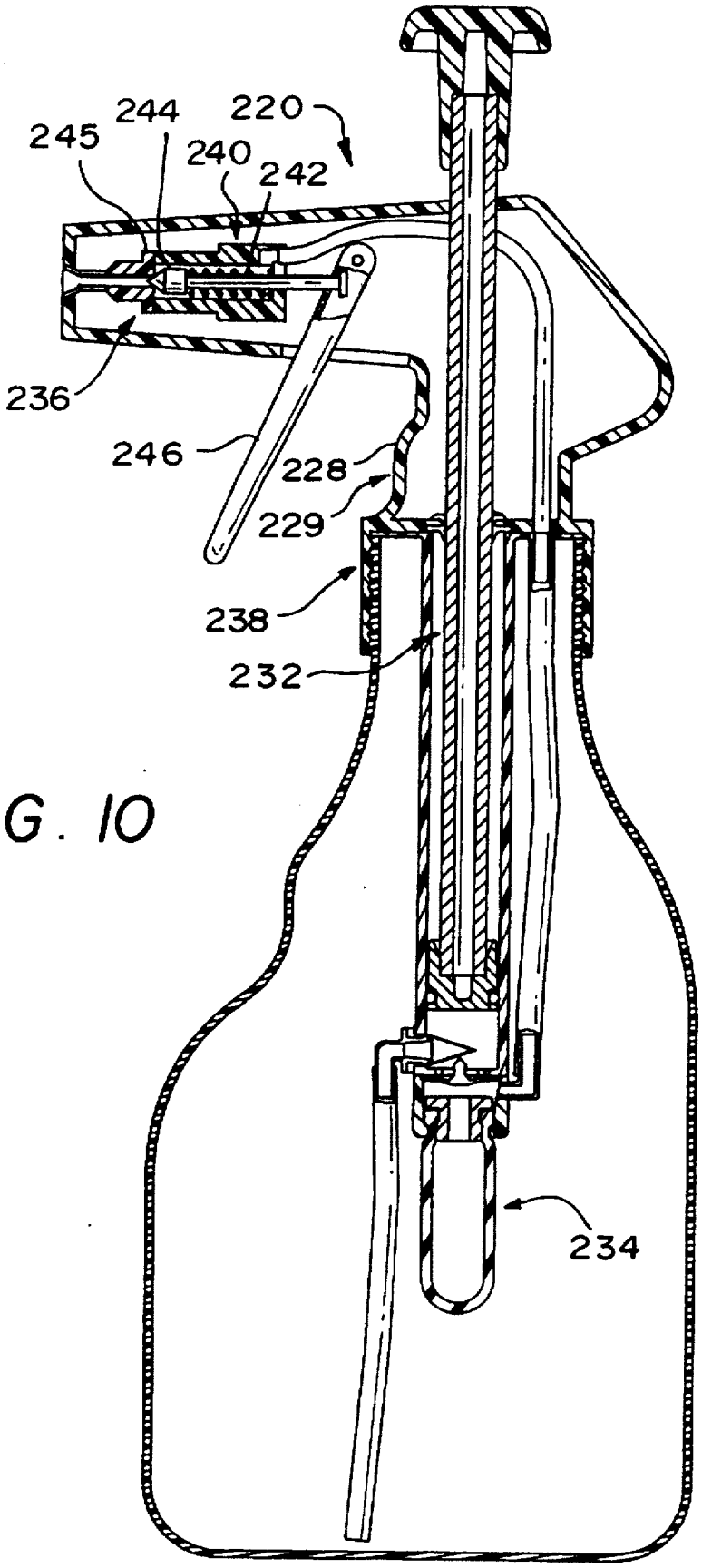
FIG. 10 is a sectional view of still another embodiment of the pump sprayer of the present invention.

In FIG. 10, a third embodiment of the present invention is shown. A pump sprayer apparatus 220 is shown detachably mounted to a supply container 222. The sprayer apparatus 220 is configured to resemble a trigger sprayer. The sprayer apparatus 220 includes a pump assembly 232, an accumulator assembly 234, a discharge assembly 236, and an attachment means 238. The pump assembly 232 and the accumulator assembly 234 are generally similar to the pump assembly 32 and the accumulator assembly 34, respectively, in the embodiment shown in FIG. 1, and thus, a detailed explanation will not be given for these elements.

The sprayer apparatus 220 differs from the sprayer apparatus 20 in that gripping ridges 228 are formed on a generally cylindrical portion 229 of connecting means 238, and a discharge valve 240 is integrally formed with attachment means 238. The discharge valve 240 is designed to be normally in a closed position and is held therein by a compression spring 242 urging a head 244 against a valve stop 245. A trigger handle 246 is operable to pull the head 244 back against spring 242 to open valve 240.

Figure 11:
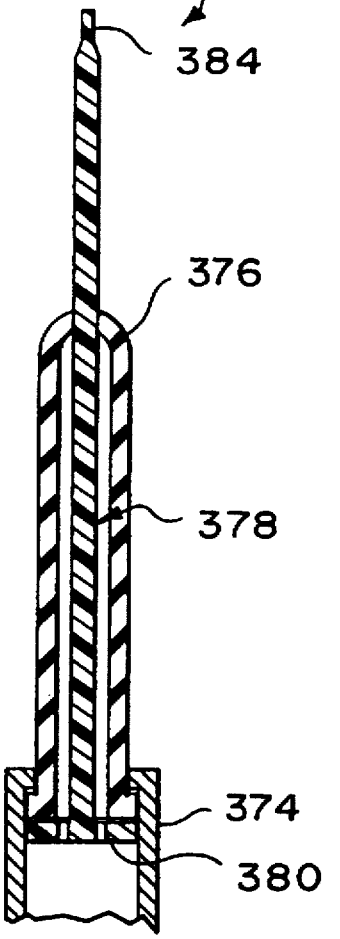
FIG. 11 is sectional view of another embodiment of an expandable accumulator for use in a pump sprayer of the present invention.
Figure 12:
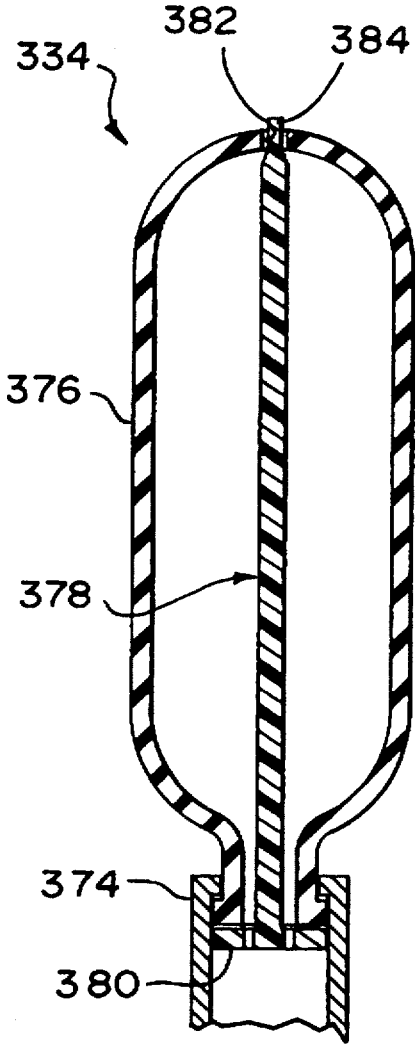
FIG. 12 is a sectional view of the accumulator shown in FIG. 11 in an expanded volume condition.

With reference to FIGS. 11 and 12, there is shown another embodiment of an expandable accumulator assembly which can be used with the pump sprayer apparatus of the present invention. Expandable accumulator assembly 334 comprises an elastomeric bladder 376 which is adapted to be mounted in a manifold indicated schematically at 374. The bladder 376 includes a relatively rigid rod or mandrel 378 which extends from a disc 380 mounted in manifold 374. The rod 378 and disc 380 can be made from polyethylene. The rod 378 extends through the interior of the bladder 376 and through an opening 382 contained in the bladder 376. When fluid is pumped into the bladder 376, the bladder expands from an initial volume condition (shown in FIG. 11), where rod 378 substantially blocks passage of fluid through opening 382, to an expanded volume condition (shown in FIG. 12), where an end 384 of reduced diameter from rod 378 permits some fluid to escape through the opening 382. The rod 378 helps maintain the stability of bladder 376 during normal working conditions, and it also functions in conjunction with opening 382 to relieve pressure and prevent blowout in the bladder 376 if fluid volume in the bladder beyond a predetermined point.

Figure 13:
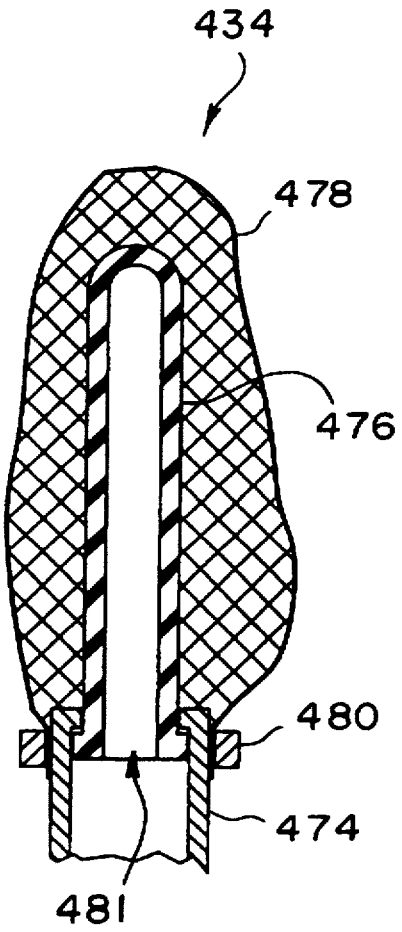
FIG. 13 is a sectional view of still another embodiment of an expandable accumulator for use in a pump sprayer of the present invention.
Figure 14:
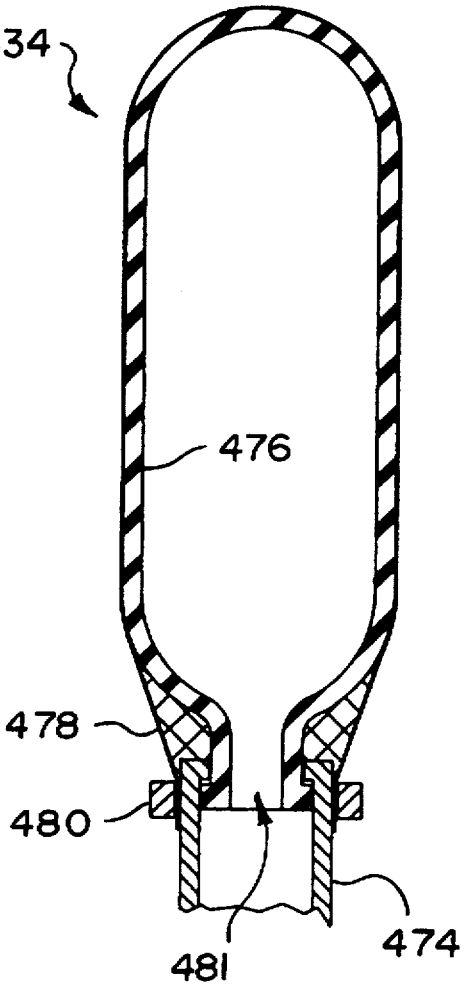
FIG. 14 is a sectional view of the accumulator shown in FIG. 13 in an expanded volume condition.

With reference to FIGS. 13 and 14, there is shown another embodiment of an expandable accumulator assembly which can be used with the pump sprayer apparatus of the present invention. Expandable accumulator assembly 434 comprises an elastomeric bladder 476 which is adapted to be mounted in a manifold indicated schematically at 474. The bladder 476 is shown in an initial volume condition in FIG. 13 and in an expanded volume condition in FIG. 14. Surrounding the exterior surface of the bladder 476 is a mesh restrainer 478 which is secured to manifold 474 by means of a collar 480. The collar 480 clamps restrainer 478 to the manifold 474 adjacent an inlet 481 of the bladder 476. Restrainer 478 can be made from a material such as nylon or stainless steel. The mesh restrainer 478 provides strong resistance to further expansion of the bladder 476 once its expanded volume condition has been reached. The effect of this resistance is to make the operation of the pump assembly very difficult and thereby signal the operator that the accumulator is fully charged. Thus, the restrainer 478 prevents blowout of the bladder 476 by mechanically limiting the amount of fluid pumped into the bladder, and by signaling a full condition to the operator.

Figure 15:
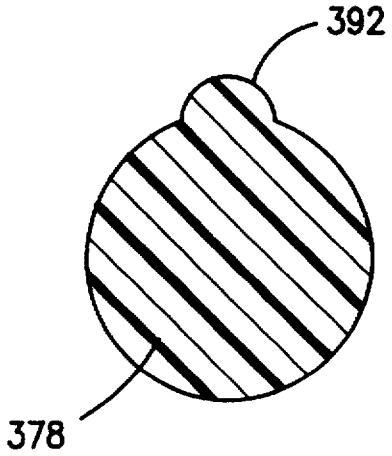
FIG. 15 is a cross sectional view of a bleed off structure.
Figure 16:
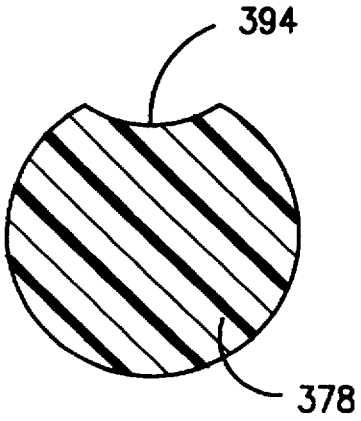
FIG. 16 is a cross sectional view of an alternative bleed off structure.

Referring to FIGS. 15 and 16 the pump sprayer 20 may include a bleed off or deflator to prevent storage of the apparatus in a charged, or pressurized state. The bleed off can be accomplished in a variety of ways including a small aperture or apertures in the accumulator 76 or seal so that low rate intentional leaks are created. Alternatively, the mandrel 378 can include a bleed rib 392 or bleed channel 394 which prevents a fluid seal between the bladder 376 and the mandrel 378 during any pressurized state of the bladder. The bleed rib or channel is selected so that a bleed rate is substantially less than the designed discharge rate.

The present construction provides a constant delivery rate, spray pattern and particle size, without requiring a pressure vessel by providing a sprayer comprising a supply tank, an expandable accumulator, a pump mechanism, an intake valve, and a discharge valve. The supply tank is designed to hold a specific quantity of application fluid. The expandable accumulator is preferably an elastomeric bladder. The function of the expandable accumulator is to accumulate the application fluid under pressure as its volume expands from an initial volume to an expanded volume.

As the volume of the elastomeric bladder expands from an initial volume to an expanded volume (when pressurized application fluid enters from the pump mechanism), energy is being stored in the elastic of the bladder. The energy is returned to the liquid when the liquid is discharged from the bladder. As the liquid is discharged, the bladder's volume contracts from the expanded volume to its initial volume. A bladder accumulator stores and transfers energy very efficiently because of the elastic properties of the bladder.

Another important property of the bladder accumulator is that it will hold a constant pressure as its volume expands. This property provides the sprayer of the present invention with a substantially constant pressure source, and eliminates the need for a pressure regulator for constant pressure applications.

The pump assembly is in fluid communication with the supply tank. The function of the pump assembly is to pump liquid from the supply tank into the expandable accumulator or bladder. An intake valve, associated with an inlet opening contained in the expandable accumulator, enables a unidirectional flow of liquid from the pump assembly to the expandable accumulator through the inlet opening.

Discharge of fluid from the expandable accumulator also occurs through the inlet opening. This fluid discharge is controlled by a discharge or shutoff valve which normally operates to either open or close the path of fluid discharge. The discharge valve is normally closed to permit the expandable accumulator to accumulate a desired quantity of fluid under pressure. When the discharge valve is opened, the fluid is discharged from the accumulator. In the preferred embodiment, the discharge valve is hand-operated and located in a handle attached to a spray wand and nozzle. When the discharge valve is opened, the discharged fluid is directed from the accumulator and channeled through a hose, trigger handle, spray wand and spray nozzle.

A further benefit of the present sprayer is that the bladder can be characterized by a specific pressure rating, which represents the pressure, in pounds per square inch (psi), that the bladder will hold fluid under normal bladder volume requirements. This pressure rating is made known to the operator by some indicia contained on the bladder. The preferred indicia is a uniquely assigned color for each specified rating, i.e., color-coding.

The bladder accumulator is designed to be easily replaced with another accumulator having the same or a different pressure rating. This enables the operator to easily change the application pressure of the sprayer. The bladder accumulators of the present invention are configured with the same fitting so that one can be replaced with another in the sprayer. A substantially constant operating pressure is achieved from the first cycle of the pump. The operating pressure will remain substantially constant independent of the number of pump cycles and will remain constant without requiring a pressure regulator.

The substantially immediate creation and sustained constant operating pressure provides for greater control of droplet size which in turn allows greater control of drift. Therefore, proper application amounts are employed which reduces cost.

Further, by selecting from a variety of accumulator materials and constructions, the characteristics of the operating pressure can be readily adjusted to specific applications.

While the preferred embodiments of the invention have been particularly described in the specification and illustrated in the drawing, it should be understood that the invention is not so limited. Many modifications, equivalents, and adaptations of the invention will become apparent to those skilled in the art without departing from the spirit and scope of the invention, as defined in the appended claims.

What is claimed is:

1. An expandable accumulator for use with a pump sprayer having a container containing a supply of fluid and a pump for delivering fluid from the container to the accumulator, the accumulator comprising:

(a) an elastomeric bladder which is expandable from an initial volume condition to an expanded volume condition when fluid is pumped into the interior thereof, the bladder including a control opening; and (b) a rod in the interior of the bladder, the rod extending through and substantially blocking the control opening in the bladder when the bladder is in the initial volume condition and extending through and partially blocking the opening when the bladder is in the expanded volume condition.

2. An expandable accumulator, as recited in claim 1, wherein the accumulator includes a manifold, and the bladder and the rod are mounted in the manifold.

3. An expandable accumulator, as recited in claim 1, wherein the rod includes one of a bleed rib and bleed channel.

* * * * *

UNITED STATES PATENT AND TRADEMARK OFFICE

CERTIFICATE OF CORRECTION

PATENT NO. : 5,755,361
DATED : May 26, 1998
INVENTOR(S) : Mario J. Restive; Alexander C. Sarnacki It is certified that error appears in the above-identified patent and that said Letters Patent is hereby corrected as shown below:

On the title page, item [75], please correct "Samacki" to read -- Sarnacki --.

Signed and Sealed this
Eighth Day of September, 1998

*Attest:*

*Attesting Officer*

BRUCE LEHMAN

*Commissioner of Patents and Trademarks*